US009880495B2

(12) United States Patent
Noguchi et al.

(10) Patent No.: US 9,880,495 B2
(45) Date of Patent: Jan. 30, 2018

(54) DEVELOPER CONTAINER, DEVELOPING APPARATUS, PROCESS CARTRIDGE, AND IMAGE FORMING APPARATUS FOR DETECTING AN AMOUNT OF DEVELOPER BASED ON A CHANGE IN ELECTRIC CAPACITANCE

(71) Applicant: CANON KABUSHIKI KAISHA, Tokyo (JP)

(72) Inventors: Bunro Noguchi, Suntou-gun (JP); Taku Watanabe, Susono (JP); Masahito Kato, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/493,599

(22) Filed: Sep. 23, 2014

(65) Prior Publication Data

US 2015/0086228 A1 Mar. 26, 2015

(30) Foreign Application Priority Data

Sep. 24, 2013 (JP) ..... 2013-197218
Jul. 28, 2014 (JP) ..... 2014-152908

(51) Int. Cl.
*G03G 15/08* (2006.01)

(52) U.S. Cl.
CPC ..... *G03G 15/0889* (2013.01); *G03G 15/086* (2013.01)

(58) Field of Classification Search
CPC ..... G03G 2215/0888; G03G 15/05824; G03G 15/0824; G03G 15/0829; G03G 15/0831; G03G 15/086; G03G 15/0889; G03G 15/09; G03G 15/0893; G03G 15/0812
USPC ..... 399/27, 61, 63, 260
See application file for complete search history.

(56) References Cited

U.S. PATENT DOCUMENTS 6,463,223 B1 * 10/2002 Karakama ..... G03G 21/1867 324/658
2002/0025174 A1 * 2/2002 Sakurai et al. ..... 399/13
2003/0161644 A1 * 8/2003 Yokoi et al. ..... 399/27
2015/0086226 A1 * 3/2015 Noguchi et al. ..... 399/27

FOREIGN PATENT DOCUMENTS

JP 09-190067 A 7/1997
JP 2007-264612 A 10/2007

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

This disclosure provides a developer container in which a conductive resin sheet is used as an electrode for detecting an amount of developer by using electrostatic capacitance. A configuration in which an end of the conductive resin sheet in a longitudinal direction is provided outside an end of a sheet member in a longitudinal direction, or a configuration in which the sheet member starts contact with the conductive resin sheet from a second surface on the downstream side in a direction or rotation than a first surface are also provided.

14 Claims, 9 Drawing Sheets

DEVELOPER CONTAINER, DEVELOPING APPARATUS, PROCESS CARTRIDGE, AND IMAGE FORMING APPARATUS FOR DETECTING AN AMOUNT OF DEVELOPER BASED ON A CHANGE IN ELECTRIC CAPACITANCE

BACKGROUND OF THE INVENTION

Field of the Invention

This disclosure relates to a technology for detecting an amount of developer by detecting a change in electric capacitance.

Description of the Related Art

Many of electrophotographic image forming apparatuses are provided with a remaining-amount-of-toner detecting device configured to notify a user when a developer (hereinafter, referred to as toner) is consumed. Examples of the remaining-amount-of-toner detecting device include a system that detects a change in electrostatic capacitance between a plurality of electrodes arranged in a developing container and detects an amount of toner. The electrodes are generally configured as a so-called electrode plate detecting type in which an electrode plate is arranged at a predetermined distance from a developer bearing member, and electrostatic capacitance between the electrode and the developer bearing member is detected.

In order to improve a remaining-amount-of-toner detection accuracy, a method of using a comparison with a comparison circuit as described in Japanese Patent Laid-Open No. 9-190067 is proposed. In addition, a method of providing a comparison circuit and being added with a stirring cycle as described in Japanese Patent Laid-Open No. 2007-264612 is also proposed.

However, the apparatus configured to detect the remaining amount of toner has a high cost, and hence further cost reduction has been required.

SUMMARY OF THE INVENTION

Accordingly, this disclosure provides a developer container configured to accommodate developer, including: a stirring member having a sheet member for stirring the developer; and a conductive resin sheet arranged so as to come into contact with the sheet member when the stirring member rotates for detecting an amount of developer by using electrostatic capacitance, wherein an end of the conductive resin sheet in a longitudinal direction is provided outside the end of the sheet member in the longitudinal direction.

This disclosure also provides a developer container configured to accommodate developer including: a stirring member having a sheet member for stirring the developer; and a conductive resin sheet arranged so as to come into contact with the sheet member when the stirring member rotates for detecting an amount of developer by using electrostatic capacitance, wherein the conductive resin sheet includes at least a first surface as a side surface located on an upstream side of the stirring member in a direction of rotation thereof; and a second surface configured to be capable of coming into contact with the developer, and at the time of rotating and coming into contact with the conductive resin sheet, one end of the sheet member is configured to start contact with the conductive resin sheet from the second surface located on the downstream side of the first surface in the direction of rotation.

In addition, this disclosure provides a developing apparatus in which a conductive resin sheet is used, a process cartridge, and an image forming apparatus.

According to this disclosure, a cost reduction is enabled by replacing a SUS plate with the conductive resin sheet.

Further features of the present invention will become apparent from the following description of exemplary embodiments with reference to the attached drawings.

DESCRIPTION OF THE EMBODIMENTS

Example 1

Description of Image Forming Apparatus and Image Forming Process

Figure 1:
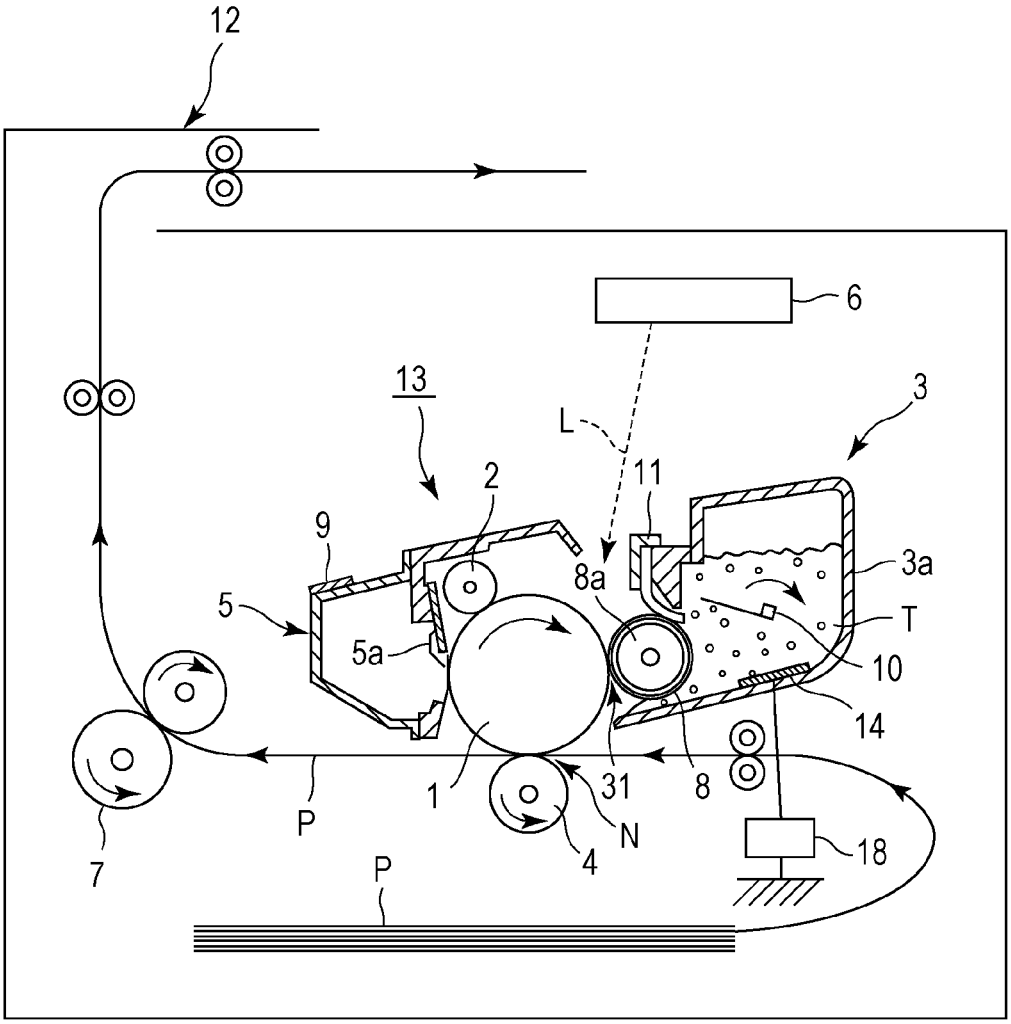
FIG. 1 is a schematic configuration drawing illustrating an image forming apparatus having a developing apparatus of Example 1.

FIG. 1 illustrates a schematic configuration of an electrophotographic system laser beam printer as an example of an image forming apparatus of this disclosure.

An image forming apparatus 12 in which an electrophotographic technology of Example 1 is used includes a drum-shaped electrophotographic photoreceptor (hereinafter, referred to as "photosensitive drum") 1 as an image bearing member. A charge roller 2, an exposure apparatus 6, a developing apparatus 3, a transfer roller 4, and a cleaning apparatus 5 are disposed along a direction of rotation of the photosensitive drum 1 in the periphery of the photosensitive drum 1. A fixing apparatus 7 is disposed on a downstream side of a transfer nip portion N formed between the photosensitive drum 1 and the transfer roller 4 as a transfer device in a direction of conveyance of a transfer material.

Detailed Description of Image Forming Apparatus

In Example 1, the photosensitive drum 1 includes an OPC photosensitive layer on an aluminum drum base body, and is rotated in a direction of an arrow (clockwise) at a predetermined peripheral speed by a driving device (not illustrated) provided on the main body side of the image forming apparatus.

The charge roller 2 as a charging device charges the photosensitive drum 1 uniformly at predetermined polarity and potential by a charging bias applied from a charging bias power source (not illustrated). As the charging bias, 1.6 kV of an AC voltage Vpp discharged sufficiently from the charge roller 2 and −560 V of a DC voltage Vdc corresponding to a dark portion potential Vd on the photosensitive drum is applied in a superimposed manner. A frequency at this time is 1600 Hz. An alternating AC component of the charging bias performs constant current control which allows an always constant current to flow between the photosensitive drum 1 and the charge roller 2.

The exposure apparatus 6 outputs a laser beam (exposure beam L), which is an image information modulated by a video controller (not illustrated) in accordance with a time series electric digital image signal from a laser output unit (not illustrated) and input from a personal computer (not illustrated) or the like. The exposure beam L forms an electrostatic latent image corresponding to the image information by scanning and exposing the surface of the charged photosensitive drum 1. In Example 1, the exposure beam L is radiated so that a bright portion potential V1 on the photosensitive drum becomes −130 V.

The developing apparatus 3, a voltage application device 15, and a remaining-amount-of-developer detecting device (remaining-amount-of-toner detecting device) 17 will be described later in detail.

The transfer roller 4 as the transfer device comes into contact with the surface of the photosensitive drum 1 at a predetermined pressing force, forms a transfer nip portion N, and is subjected to an application of a transfer bias from a transfer bias power source (not illustrated). The transfer bias transfers a developer image (toner image) on the surface of the photosensitive drum 1 onto a transfer material P such as a printing sheet at the transfer nip portion N between the photosensitive drum 1 and the transfer roller 4.

The fixing apparatus 7 includes a heat roller and a pressing roller provided with a halogen heater (not illustrated) in an interior thereof. The toner image transferred onto the surface of the transfer material P is heated, melted, and pressed to be thermally fixed to fix an image to the transfer material while transferring the transfer material P in a state of being nipped at a fixing nip between a fixing roller and the pressing roller. The image on the transfer material P after the completion of fixation is discharged to the outside the image forming apparatus 12.

A cleaning blade 5*a* as a cleaning device cleans developer (toner) which is not transferred and remains on the photosensitive drum 1, and the photosensitive drum 1 is provided for image formation again.

In Example 1, the photosensitive drum 1, the charge roller 2, the developing apparatus 3, and the cleaning blade 5*a* are integrally unitized, and form a process cartridge 13 which is demountably mountable with respect to the main body of the image forming apparatus.

Detail of Developing Apparatus

Figure 3:
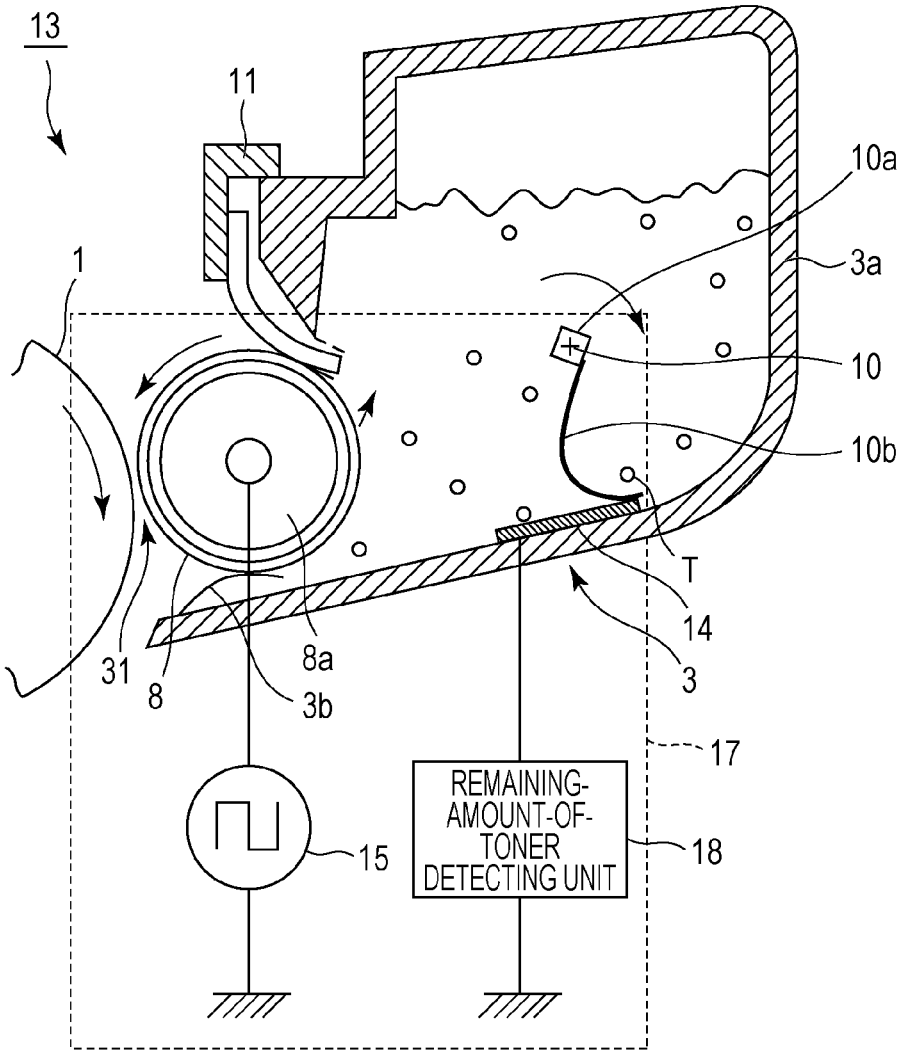
FIG. 3 is a schematic cross-sectional drawing illustrating a configuration of the developing apparatus of Example 1.

With reference to FIG. 3, the developing apparatus 3 is described in detail. The developing apparatus 3 is provided with a stirring member 10 having a developing container 3*a* for accommodating developer (hereinafter, referred to as toner T) and a sheet member 10*b* configured to stir the toner T. The developing apparatus 3 is also provided with a developing sleeve 8 and a magnet roller 8*a* as developer bearing members, a developing blade 11 configured to regulate the layer thickness of the toner T, and an antenna member 14 configured to detect a remaining amount of developer (hereinafter, referred to as a remaining amount of toner).

In Example 1, magnetic one-component toner having an average particle diameter of 7 μm is used as the toner T. However, non-magnetic toner or two-component toner can also be applied.

The stirring member 10 includes a supporting rod and the sheet member (hereinafter, referred to as a stirring sheet). A supporting rod 10*a* is supported at both end thereof by the developing container 3*a*, and a center of the supporting rod 10*a* corresponds to a rotating axis 10*c*. As illustrated in FIG. 3, the supporting rod 10*a* rotates clockwise. In Example 1, the supporting rod 10*a* makes one turn per approximately one second. The stirring sheet uses a PPS sheet (polyphenylene sulfide sheet) having a thickness of 100 μm is used and is pressure-bonded to the supporting rod at one of end in a short side direction. The width of the stirring sheet in a longitudinal direction is 210 mm.

The developing sleeve 8 used here is an aluminum sleeve formed of a non-magnetic member coated with a resin layer having a medium resistance on the surface thereof. The developing sleeve 8 is arranged at a position facing the surface of the photosensitive drum 1, and both end of the developing sleeve is rotatably supported at an opening portion of the developing apparatus 3. The voltage application device 15 arranged on the main body of the image forming apparatus is connected to the developing sleeve, and bias is applied at a predetermined timing at the time of printing. In Example 1, a square waver of a frequency of 2000 Hz at a DC voltage Vdc of −400 V and an AC voltage Vpp of 1400 V is applied during printing.

The magnet roller 8*a* as a magnetic field generating device is provided in the developing sleeve 8, and a plurality of magnetic poles N and S are formed alternately. Since the magnet roller 8*a* is held always at a constant position without performing a rotating action, the magnetic poles are maintained always in the same direction.

The developing blade 11 is a urethane rubber blade fixedly adhered to a supporting metal plate. The supporting metal plate is fixed to the developing container 3*a* so as to come into contact with the developing sleeve 8 at an adequate abutment pressure for regulating the layer thickness of the toner T adequately and causing frictional electrification.

The seal member 3*b* is adhered into the developing container 3*a* so that the toner T is not leaked from an area in the drawing in order to prevent toner leakage during transportation or the like.

A conductive resin sheet is employed for the antenna member 14 to be arranged on a bottom surface of an inner wall of the developing container 3*a*. Accordingly, the cost can be reduced in comparison with an SUS plate of the related art. In Example 1, the conductive resin sheet having conducting properties secured by dispersing a carbon material in acetyl vinyl acetate (EVA) is used. As the carbon material, carbon black, carbon fiber, graphite, and so on can be employed. The resin is not limited to EVA, but may be polystyrene (PS). The resin to be used does not have to be EVA or the carbon material as long as the material has the conducting properties, and conducting polymer may be used directly. A method of fixing the antenna member 14 employed here is a method of adhering the antenna member 14 directly on the bottom surface of the inner wall of the developing container 3*a* with double-sided adhesive tape. A fixing method is not limited to the fixation by the double-sided adhesive tape, any method such as insert molding, coating, two-color molding or the like may be employed as long as the fixation to a frame as an electrode is achieved.

Figure 2A:
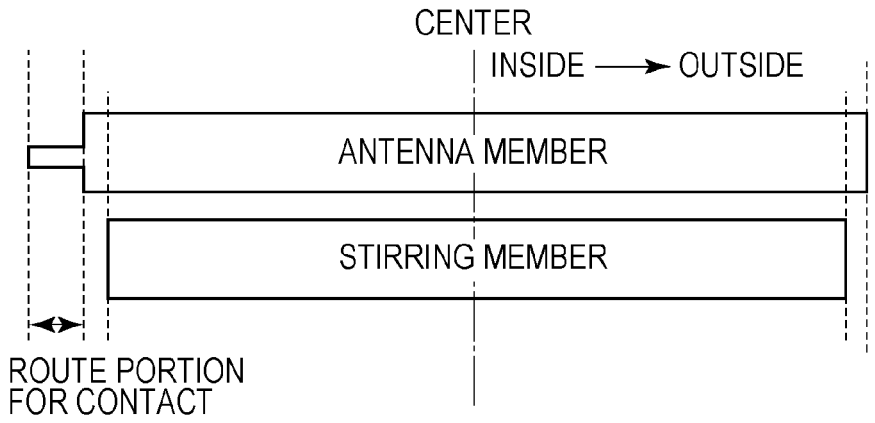
FIGS. 2A to 2C are drawings illustrating positional relationships between a stirring member and an antenna member in a longitudinal direction thereof.

The form of the antenna member 14 is a rectangular sheet having a longitudinal width of 216 mm, a short width of 15 mm, and a thickness of 100 μm as illustrated in FIG. 2A. Since the width of the stirring sheet has a length of 210 mm, the difference at the end thereof is 6 mm. The length from an end of the stirring sheet to an end of the conductive resin sheet the antenna member is preferably larger than 0 mm and not larger than 20 mm. A route portion which continues to a contact point (not illustrated) arranged outside the developing container 3*a* is also formed at one of longitudinal end thereof as the antenna member 14 as illustrated in FIG. 2A. In Example 1, the route portion is integral with the antenna member. However, the route portion may be attached separately to the developing container 3*a* by using metal having conductive properties. A configuration in which the rectangular antenna member may be connected directly to the contact without providing the route portion is also applicable.

As illustrated in FIG. 2A, the end of the conductive resin sheet as the antenna member 14 in the longitudinal direction is located outside the end of the sheet member (stirring sheet) 10*b* as part of the stirring member in the longitudinal direction.

This configuration may cause a problem to be considered in the case where the conductive resin sheet as the electrode plate is fixed to the inner wall in the developing container, and the sheet member of the stirring member rotates in contact with the electrode plate. It is because the conductive resin sheet itself has a strength lower than the SUS plate. For example, in the case where the end of the sheet member in the longitudinal direction is located outside the end of the conductive resin sheet in the longitudinal direction, the end of the conductive resin sheet in the longitudinal direction is repeatedly scraped by the sheet member during a long time of use. Consequently, there is a probability of separation from the end or breakage of the conductive resin sheet. When the conductive resin sheet is separated or broken, the electrostatic capacitance cannot be detected accurately, and the accuracy of detection of the remaining amount of toner is lowered.

Therefore, in Example 1, a configuration in which the end of the conductive resin sheet as the antenna member 14 in the longitudinal direction is located outside the end of the sheet member (stirring sheet) 10*b* as part of the stirring member 10 in the longitudinal direction is employed.

By employing this configuration, separation or breakage of the conductive resin sheet may be reduced. Therefore, lowering in accuracy of detection of the remaining amount of toner due to the separation or the breakage of the antenna member 14 may be reduced.

Figure 2B:
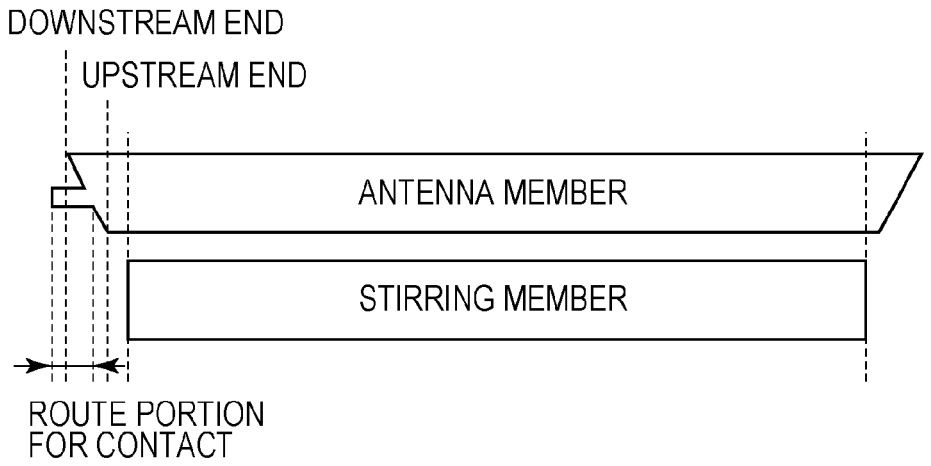
Figure 2C:
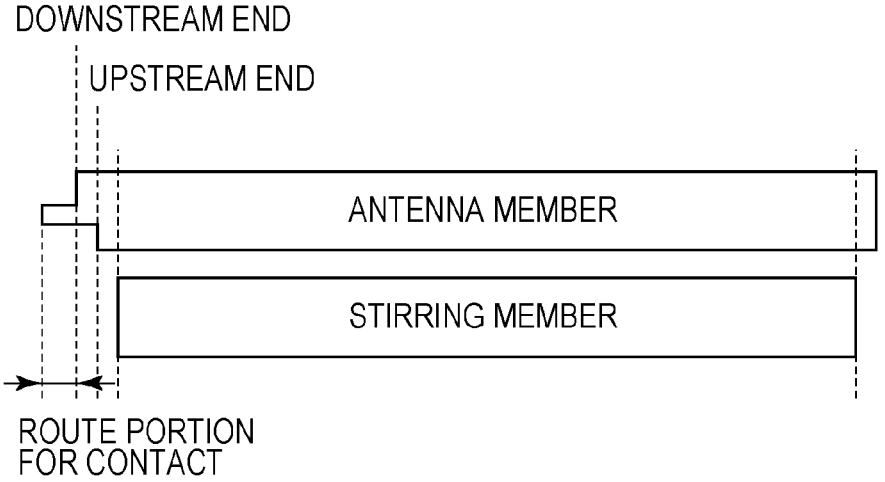
Figure 8:
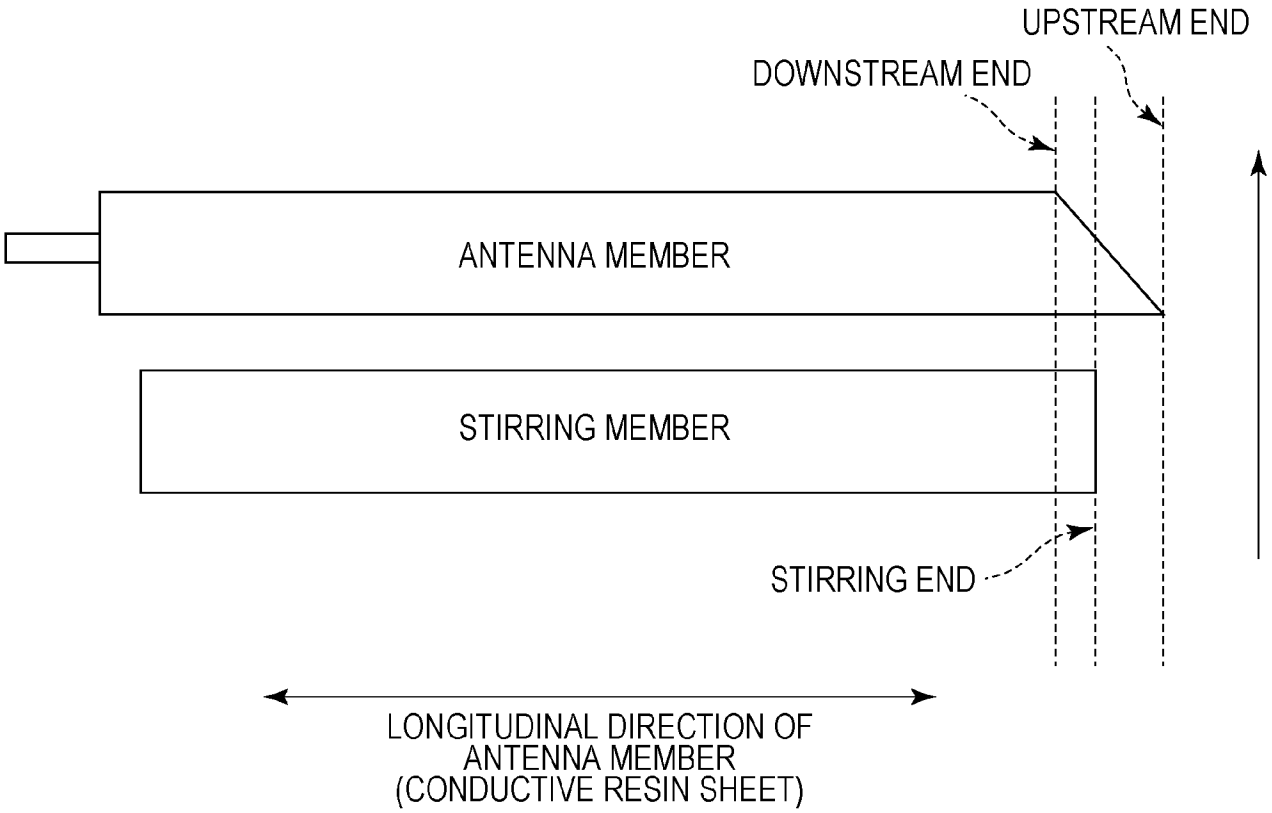
FIG. 8 is a relationship drawing of the stirring member and the antenna member in the longitudinal direction thereof.

The positional relationship between the end of the conductive resin sheet in the longitudinal direction and the end of the sheet member in the longitudinal direction is not limited to that illustrated in FIG. 2A, and may be positional relationships illustrated in FIGS. 2B and 2C and FIG. 8. In FIG. 2B, the antenna member 14 has a trapezoidal shape, and the end of the conductive resin sheet in the longitudinal direction has an upstream end on the upstream side and a downstream end on the downstream side in the direction of rotation. Then, the upstream end and the downstream end are located outside the end of the sheet member as the stirring member. The shape illustrated in FIG. 2C also has the same configuration. In this case as well, equivalent effects as Example 1 are achieved.

The positional relationship among the respective end is preferably such that one end of the conductive resin sheet, one end of the sheet member (stirring sheet), the other end of the stirring sheet, and the other end of the conductive resin sheet are located in this order in the longitudinal direction of the conductive resin sheet.

In addition, as illustrated in FIG. 8, a configuration in which the end of the sheet member is located at an end in the longitudinal direction of the conductive resin sheet between the upstream end on the upstream side and the downstream end in the downstream side in the direction of rotation is also applicable. In this case, in terms of reduction of separation of the conductive resin sheet, the upstream end needs to be located outside the end of the sheet member. In Example 1, a distal end of the stirring sheet 10*b* of the stirring member 10 comes into contact with the conductive resin sheet as the antenna member 14. Accordingly, even when the remaining amount of toner is small, the toner on the antenna member 14 may be conveyed to a position in the vicinity of the developing sleeve. Therefore, in the case where the stirring sheet does not come into contact with the antenna member and the toner does not remain on the antenna member 14 non-uniformly, this configuration is advantageous for improving the accuracy of detection of the remaining amount of toner correspondingly. In Example 1, the stirring sheet is configured to come into contact over the entire portion from the upstream side end portion to the downstream side end portion in the short side direction of the antenna member 14.

In this configuration, the toner T in the vicinity of the developing sleeve 8 is supplied to the surface of the developing sleeve 8 by a magnetic field of the magnet roller 8*a*. Subsequently, the toner T on the surface of the developing sleeve 8 is optimized in layer thickness by the developing blade 11 and is provided with an electric charge by frictional electrification. The toner T provided with the electric charge makes an electrostatic latent image on the photosensitive drum 1 visible as a toner image in a developing area 31.

The developing apparatus has been described thus far. However, this disclosure can be applied to a developer container in which developer is accommodated only for using the detection of the amount of developer. In such a case, the container is not provided with the developing sleeve as the developer bearing member.

Description of Remaining-Amount-of-Developer (Remaining-Amount-of-Toner) Detecting Device Referring now to FIG. 3, subsequently, the remaining-amount-of-toner detecting device using a change in value of electrostatic capacitance used in Example 1 will be described.

In Example 1, the remaining-amount-of-toner detecting device 17 includes the voltage application device 15 configured to apply bias to the electrode, the developing sleeve 8 as the electrode, the antenna member 14 as a counter electrode, and a remaining-amount-of-developer detecting apparatus (remaining-amount-of-toner detecting apparatus) 18.

The conductive resin sheet as the antenna member 14 is arranged so as to come into contact with a contact point (not illustrated) arranged on the near side on the paper plane of the bottom surface of the developing container 3*a* via the route portion described above, and is connected to the earth via the remaining-amount-of-toner detecting apparatus 18 arranged on the image forming apparatus.

In the configuration described above, by applying bias to the developing sleeve 8 by the voltage application device 15, the electrostatic capacitance between the developing sleeve 8 and the antenna member 14 may be detected by the remaining-amount-of-toner detecting apparatus 18. At this time, since the relative permittivity of the toner is larger than the relative permittivity of air, if the amount of toner present between the electrodes increases, the detected electrostatic capacitance is increased. In the configuration of Example 1, successive detection of remaining amount that detects the electrostatic capacitance successively is performed during printing.

Method of Calculating Amount of Developer (Amount of Toner)

Subsequently, a method of calculating the remaining amount of developer (hereinafter, referred to as the remaining amount of toner) relating to the remaining amount in the amount of developer (hereinafter, referred to as the amount of toner) will be described with reference to FIG. 4.

Figure 4:
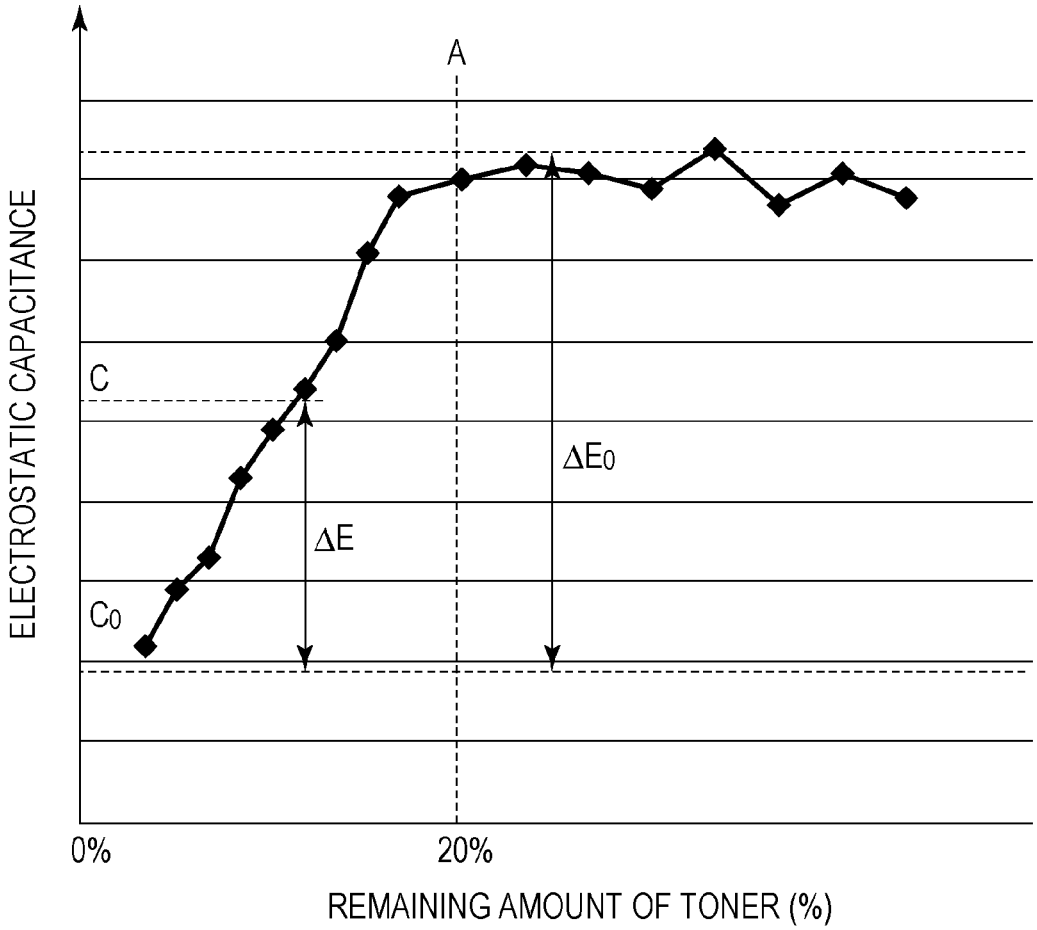
FIG. 4 is a drawing illustrating a relationship between a remaining amount of toner and electrostatic capacitance in Example 1.

FIG. 4 is a drawing illustrating a relationship between a remaining amount of toner and electrostatic capacitance of this disclosure. A vertical axis represents the electrostatic capacitance detected by the remaining-amount-of-toner detecting device 17, and a lateral axis represents the remaining amount of toner. In the configuration of Example 1, there is no change in electrostatic capacitance from an initial point (when the toner is full: 100%) to a point of 20% (dot line A). It is because a sufficient amount of toner remains, and hence the amount of toner between the developing sleeve 8 and the antenna member 14 is the same. When the remaining amount of toner becomes less than 20%, the electrostatic capacitance is linearly reduced as the remaining amount of toner reduces. This indicates that the amount of toner between the developing sleeve 8 and the antenna member 14 changes in accordance with the remaining amount of toner.

Here, the difference between an electrostatic capacitance $C_0$ in the state in which no toner is present between the developing sleeve 8 and the antenna member 14 when the product is brand new, and the electrostatic capacitance when the remaining amount of toner is 100% (full) to 20% is defined as $\Delta E_0$. When the average value of the electrostatic capacitance while one image is printed is configured to be output as an electrostatic capacitance C, the difference between the electrostatic capacitance during the image printing and the electrostatic capacitance $C_0$ in the state in which no toner is present between the developing sleeve 8 and the antenna member 14 is defined as $\Delta E$. Therefore, the current remaining amount of toner is calculated by the following expression (1)

$$\text{Current remaining amount of toner} = 20\% \times \Delta E / \Delta E_0 \quad \text{Expression (1).}$$

The result of detection is displayed on a display unit (not illustrated) provided on the image forming apparatus or a monitor (not illustrated) of the personal computer to notify a user.

Configuration of Comparative Example 1

A configuration of Comparative Example 1 is different in positional relationship in the longitudinal direction between the conductive resin sheet as the antenna member 14 and the stirring member 10 in comparison with Example 1. In contrast to Example 1, in Comparative Example 1, the conductive resin sheet has a longitudinal width of 216 mm and the stirring sheet has a longitudinal width of 220 mm so that a longitudinal end of the antenna member 14 is located inside a longitudinal end of the stirring sheet of the stirring member. Therefore, the stirring sheet is configured to come into contact with a corner portion of the conductive resin sheet. Other configurations are the same as those of Example 1.

Comparison Between Example 1 and Comparative Example 1 by Breakdown Test

With the configurations of Example 1 and Comparative Example 1, a breakdown test was actually conducted for 15000 pieces of the printing sheets until being outlined due to toner shortage. Comparison of the remaining-amount-of-toner detection accuracy was conducted while confirming the state of separation or breakage of the conductive resin sheet as the antenna member 14 in this breakdown test.

First of all, the state of separation and breakage of the antenna member 14 is shown in Table 1.

TABLE 1

COMPARISON OS SATE OF ANTENNA MEMBER BETWEEN EXAMPLE 1 AND COMPARATIVE EXAMPLE 1

| | 0 | 5000 pieces | 10000 pieces | 15000 pieces |
|---|---|---|---|---|
| Example 1 | no problem | no problem | no problem | no problem |
| Comparative Example 1 | no problem | no problem | separation | breakage |

As shown in Table 1, the configuration of Example 1 had no problem. In the configuration of Comparative Example 1, however, separation and breakage of the antenna member 14 occurred when the number of pieces of the printing sheets is increased to 10000 pieces or more. The separation meant the state in which the double-sided adhesive tape that adheres the conductive resin sheet to the developing container 3*a* is separated, and part of the conductive resin sheet is turned upward every time when coming into contact with the stirring sheet. The breakage meant the state in which the conductive resin sheet was in a state of being bent and having lost partly.

It seems that the reason why there was no separation or breakage in the configuration of Example 1 was that the positional relationship in the longitudinal direction was different from that of Comparative Example 1 and the stirring sheet did not come into contact with the corner portion of the conductive resin sheet having a rectangular shape. The corner portion means specifically a corner portion of the conductive resin sheet located upstream in the direction of rotation. The portion that corresponds to the corner of the rectangular was the weakest in terms of adhesiveness in comparison with other portions, and hence was susceptible to separation when being scraped repeatedly.

From these reasons, in the case of a design in which the length of the stirring sheet in the longitudinal direction is longer than the length of the conductive resin sheet in the longitudinal direction, the usage is limited such as the usage for a small developer container.

Figure 5:
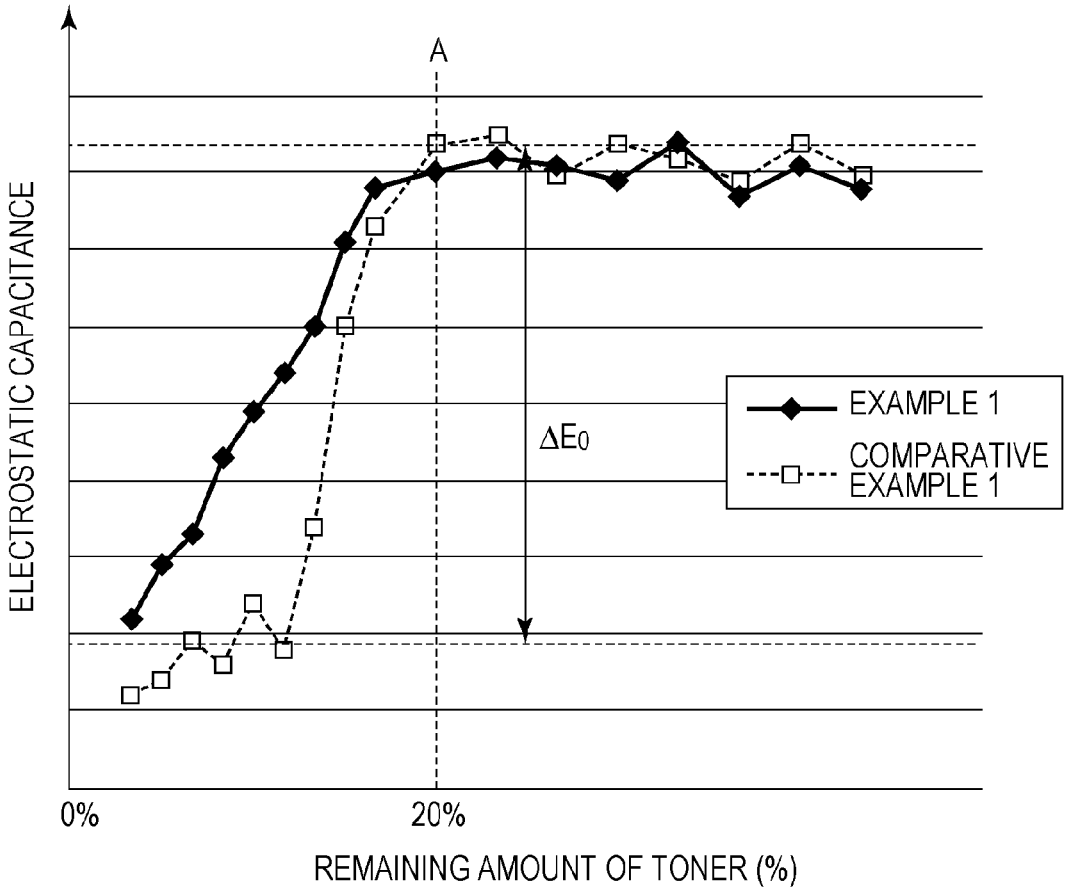
FIG. 5 is a drawing illustrating a relationship between a remaining amount of toner and electrostatic capacitance in Example 1 and Comparative Example 1.

Subsequently, transition of the output of the remaining amount of toner at the time of the breakdown test is shown in FIG. 5. In the case of Example 1, a remaining amount of toner of 0% could be detected immediately before being outlined due to the toner shortage, and the detection of the remaining amount of toner could be performed normally. However, in the configuration of Comparative Example 1, the output of the remaining amount of toner varied and a remaining amount of toner of 0% was detected significantly before being outlined due to the toner shortage.

From the breakdown test, if the design is such that the length of the stirring sheet in the longitudinal direction is longer than the length of the conductive resin sheet in the longitudinal direction, it is necessary to design the developer container which requires the replacement when the number of printing sheets reaches approximately 5000 pieces as is understood from Comparative Example 1.

This will be described by using a relative expression among an electrostatic capacitance C, a surface area S, a distance d, and a dielectric constant ∈, namely, C =∈S/d. First of all, from a time point when the separation of the conductive resin sheet as the antenna member 14 occurs, the distance d from the developing sleeve to the antenna member 14 becomes shorter every time when the conductive resin sheet is partly turned up. Therefore, even though the remaining amount of toner is the same, the electrostatic capacitance C is increased, and hence the output of the remaining amount of toner becomes large.

If the conductive resin sheet is bent or has lost its figure, the surface area S as the antenna is reduced. Therefore, the electrostatic capacitance C is reduced even when the remaining amount of toner is the same, and the output of the remaining amount of toner becomes small. Therefore, the remaining amount of toner of 0% is detected before being outlined due to the actual toner shortage.

As described thus far, with the configuration in which the end of the conductive resin sheet as the antenna member 14 in the longitudinal direction comes outside the end of the stirring sheet as the stirring member 10 in the longitudinal direction as in Example 1, separation or breakage of the antenna member 14 may be reduced. Therefore, deterioration in remaining-amount-of-toner detection accuracy due to the separation or the breakage of the antenna member 14 may be reduced.

The longitudinal width of the stirring sheet is preferably set as large as possible from the view point that the toner is conveyed to a position as close as possible to the developing sleeve. Therefore, the longitudinal end of the stirring member is preferably located as close as possible to the end of the conductive resin sheet in the longitudinal direction within a range in which separation or breakage of the conductive resin sheet does not occur.

Example 2

Unlike the positional relationship between the antenna member and the stirring sheet described in Example 1, Example 2 is characterized in that the positional relationship in which the antenna member and the stirring sheet come into contact with each other in the short side direction is defined. Even with the definition of the positional relationship in the short side direction, separation or breakage of the antenna member may be reduced and deterioration of the remaining-amount-of-toner detection accuracy may be reduced like the advantageous effects of Example 1.

Configuration of Example 2

Figure 6A:
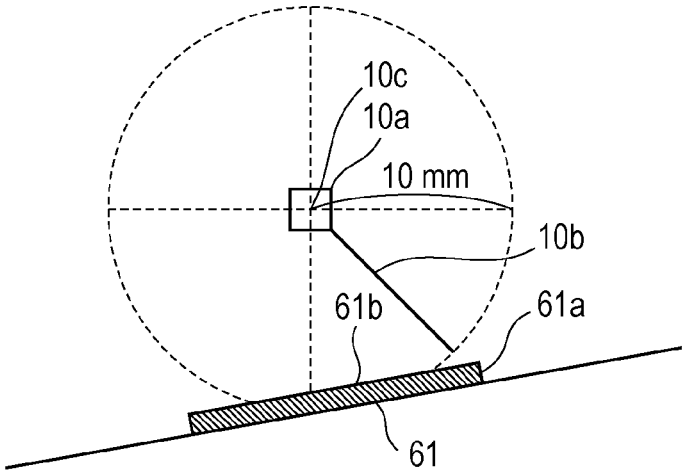
FIGS. 6A to 6C are schematic drawings illustrating configurations of a developer container of Example 2.

In Example 2, as illustrated in FIG. 6A, a conductive resin sheet 61 includes an upstream side end portion (first surface) 61*a* and a downstream surface (second surface) 61*b*, and the stirring sheet comes into contact with the downstream surface (second surface) 61*b* instead of the upstream side end portion (first surface) 61*a*. In order to realize this configuration, the width of a free end of the stirring sheet on the short side is 10 mm. The longitudinal width of the stirring sheet is 220 mm. Other configurations are the same as those of Example 1. Therefore, since the longitudinal width of the conductive resin sheet is 216 mm, the stirring sheet is arranged outside the conductive resin sheet in the longitudinal direction.

Figure 6B:
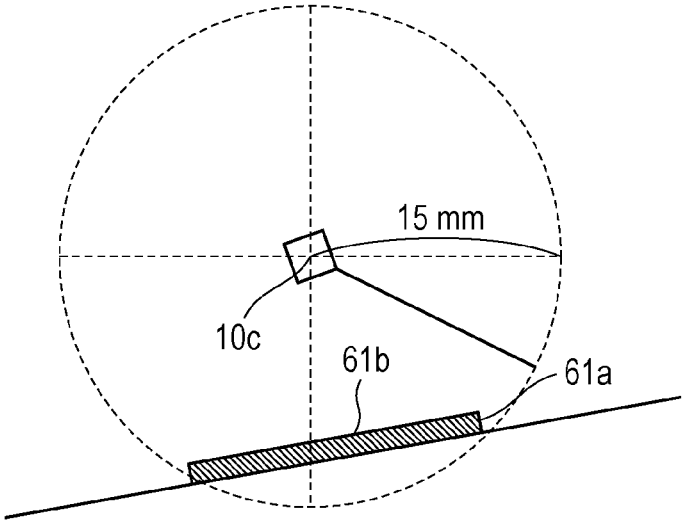
Figure 6C:
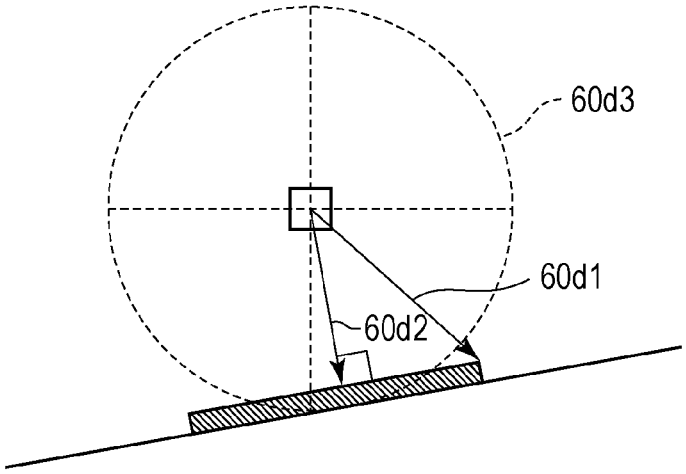

As illustrated in FIG. 6C, a shortest distance 60*d*1 (first shortest distance) from the axis of rotation of the stirring member to the first surface is longer than a shortest distance 60*d*2 (second shortest distance) from the axis of rotation of the stirring member to the second surface. Then, the relationship with respect to a stirring distance 60*d*3 from the axis of rotation to an end of the stirring sheet on the side coming into contact with the second surface becomes the second shortest distance<stirring distance<first shortest distance.

The relationship of: second shortest distance<stirring distance causes the toner on the conductive resin sheet to be stirred by the contact of the stirring sheet with the conductive resin sheet, so that the amount of toner may be detected further accurately.

The relationship of stirring distance<first shortest distance contributes to reduce probability of separation or abrasion of the conductive resin sheet caused by contact (collision) of the stirring sheet with the side surface or the corner portion of the conductive resin sheet.

Configuration of Comparative Example 2

The configuration of Comparative Example 2 is different from Example 2 in the width of the free end on the short side of the stirring member 10. In Comparative Example 2, as illustrated in FIG. 6B, in contrast to Example 2, a distal end of the stirring sheet comes into contact entirely with the upstream side end portion (first surface) 61*a* of the conductive resin sheet of the antenna member 14. Therefore, the width of the free end of the stirring sheet on the short side is 15 mm. Other configurations are the same as those of Example 2.

Comparison Between Example 2 and Comparative Example 2 by Breakdown Test

With the configurations of Example 2 and Comparative Example 2, a breakdown test was actually conducted for 15000 pieces of the printing sheets until being outlined due to the toner shortage. Comparison of the remaining-amount-of-toner detection accuracy was conducted while confirming the state of separation or breakage of the conductive resin sheet as the antenna member 14 in this breakdown test.

First of all, the state of separation and breakage of the antenna member 14 is shown in Table 2.

TABLE 2

COMPARISON OF STATE OF ANTENNA MEMBER BETWEEN EXAMPLE 2 AND COMPARATIVE EXAMPLE 2

| | 0 | 5000 pieces | 10000 pieces | 15000 pieces |
|---|---|---|---|---|
| Example 2 | no problem | no problem | no problem | no problem |
| Comparative Example 2 | no problem | no problem | separation | breakage |

As shown in Table 2, in the configuration of Example 2 had no problem, however, separation and breakage of the antenna member 14 occurred when the number of pieces of the printing sheets is increased to 10000 pieces or more in the configuration of Comparative Example 2.

It seems that the reason why there was no separation or breakage in the configuration of Example 2 was that the stirring sheet did not come into contact with a corner on the upstream end side of the conductive resin sheet having a rectangular shape. The portion that corresponds to the corner of the rectangular was the weakest in terms of adhesiveness in comparison with other portions, and hence was susceptible to separation when being scraped repeatedly. In the case of the design as in Comparative Example 2, it is necessary to design the developer container which requires the replacement when the number of printing sheets reached approximately 5000 pieces as is understood from Comparative Example 2.

As regards the transition of the output of the remaining amount of toner at the time of breakdown test, the transition of Example 2 is similar to that of Example 1 illustrated in FIG. 5, and the detection of the remaining amount of toner could be performed normally. Comparative Example 2 was the same as Comparative Example 1 in FIG. 5, and a remaining amount of toner of 0% was detected significantly longer before being outlined due to the toner shortage. The reason is the same as in Example 1 and hence description will be omitted.

As has been described thus far, with the configuration in which the stirring sheet comes into contact with the antenna member 14 on the downstream surface (second surface) rather than the upstream side end portion (first surface), separation or breakage of the antenna member 14 may be reduced. Therefore, deterioration of the detection accuracy of the remaining amount of toner caused by separation or breakage of the antenna member 14 may be reduced.

The width of the free end of the stirring sheet in the short side direction is preferably set as large as possible from the view point that the toner is conveyed to a position as close as possible to the developing sleeve. Therefore, the position of start of contact of the stirring sheet is preferably closer to the upstream side end portion in the short side direction on the upper side in the direction of thickness at an upstream position of the conductive resin sheet in the direction of rotation as much as possible within the range in which separation or breakage of the conductive resin sheet does not occur.

In addition, with a configuration in which Example 1 and Example 2 are combined, that is, a configuration in which the stirring sheet of the stirring member 10 does not come into contact with neither the end of the antenna member 14 in the longitudinal direction nor the upstream side end portion in the short side direction, a configuration in which separation or breakage of the antenna member 14 is further reduced is achieved. For example, if the longitudinal width of the stirring sheet changed to 210 mm in the configuration of Example 2, a configuration in which the stirring sheet of the stirring member 10 does not come into contact with neither the longitudinal end of the antenna member 14 nor the upstream side end portion in the short side direction is achieved.

Example 3

In Example 3, the conductive resin sheet employed as the antenna member has a two-layer structure, and includes an EVA sheet as a base layer and an urethane-based resin with carbon having conducting properties dispersed therein coated on the EVA sheet as a surface layer. The surface layer is coated over the entire area of the base layer by roll coating or dip coating. However, uneven coating may occur specifically at end thereof, and there may be a case where the end of the surface layer has an irregular surface. In such a case as well, by defining the positional relationship in the longitudinal direction and the short side direction of the stirring sheet, probability of occurrence of separation or breakage due to the irregularity at the end of the surface layer may be reduced. Two specific configurations will be described below as Example 3-1 and Example 3-2.

Configurations of Example 3-1 and Comparative Example 3-1

The conductive resin sheet as the antenna member of Example 3-1 and Comparative Example 3-1 has uneven coating on the surface layer at the end in the longitudinal direction, and hence the irregularity occurs at the end of the surface layer. Configurations other than the state of the end in the longitudinal direction and the positional relationship in the longitudinal direction are the same in Example 3-1 and Example 1, and Comparative Example 3-1 and Comparative Example 1 are the same.

Comparison between Example 3-1 and Comparative Example 3-1 by Breakdown Test

With the configurations of Example 3-1 and Comparative Example 3-1, a breakdown test was actually conducted for 15000 pieces of the printing sheets until being outlined due to the toner shortage. Comparison of the remaining-amount-of-toner detection accuracy was conducted while confirming the state of separation of the surface layer of the conductive resin sheet as the antenna member 14 in this breakdown test.

First of all, the state of separation of the surface layer of the antenna member 14 is shown in Table 3.

TABLE 3

STATE OF SEPARATION OF SURFACE LAYER OF ANTENNA MEMBER BETWEEN EXAMPLE 3-1 AND COMPARATIVE EXAMPLE 3-1

| | 0 | 5000 pieces | 10000 pieces | 15000 pieces |
|---|---|---|---|---|
| Example 3-1 | no separation | no separation | no separation | no separation |
| Comparative Example 3-1 | no separation | no separation | slight separation | separation of 10% or more of surface area |

As shown in Table 3, in the configuration of Example 3-1 had no problem, however, separation of the surface layer of the antenna member 14 occurred when the number of pieces of the printing sheets is increased to 10000 pieces or more in the configuration of Comparative Example 3-1. The term "separation of the surface layer" means the state in which part of the surface layer is completely separated, and a conductive layer of the corresponding part is missing.

It seems that the reason why there was no separation in the configuration of Example 3-1 was that the stirring sheet did not come into contact with the end in the longitudinal direction of the conductive resin sheet. In Comparative Example 3-1, the stirring sheet came into contact with the minute irregularity at the end of the surface layer in the longitudinal direction repeatedly, and hence was susceptible to separation.

Figure 7:
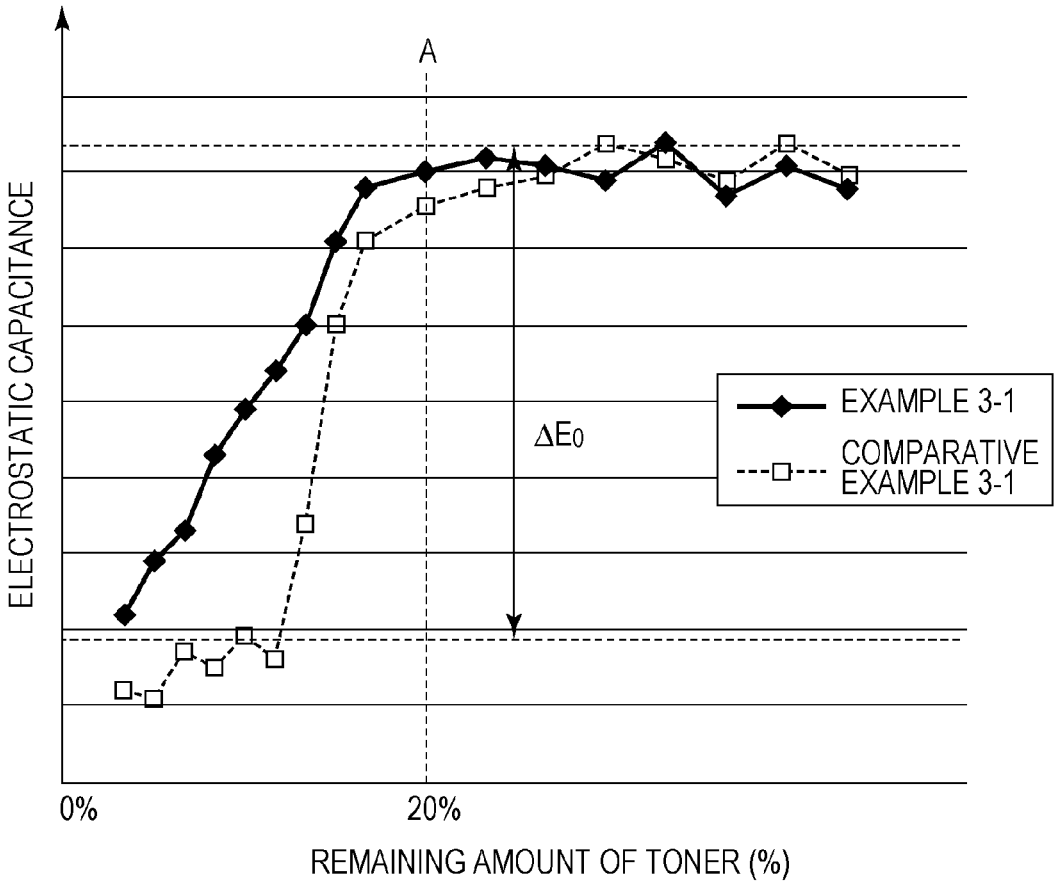
FIG. 7 is a drawing illustrating a relationship of a remaining amount of toner and electrostatic capacitance between Example 3 and Comparative Example 3.

Subsequently, transition of the output of the remaining amount of toner at the time of the breakdown test is shown in FIG. 7. In the case of Example 3-1, a remaining amount of toner of 0% could be detected immediately before being outlined due to the toner shortage, and the detection of the remaining amount of toner was normally performed. However, in the configuration of Comparative Example 3-1, a remaining amount of toner of 0% was detected significantly before being outlined due to the toner shortage.

The reason is that the surface area S is reduced due to separation of the surface layer in the relative expression among the electrostatic capacitance C, the surface area S, the distance d, and the dielectric constant $\in$, that is, $C=\in S/d$, and hence the electrostatic capacitance C is reduced even the remaining amount of toner is the same, and the output of the remaining amount of toner is also reduced. Therefore, a remaining amount of toner of 0% is detected before being outlined due to the actual toner shortage.

In the case of the design as in Comparative Example 3-1, it is necessary to design the developer container which requires the replacement when the number of printing sheets reached approximately 5000 pieces as is understood from Comparative Example 3-1. Accordingly, separation caused by the repeated contact of the stirring sheet is avoided, so that the detection accuracy of the remaining amount of toner becomes equivalent to Example 3-1.

Configurations of Example 3-2 and Comparative Example 3-2

The conductive resin sheet as the antenna member of Example 3-2 and Comparative Example 3-2 has uneven coating on the surface layer at the end in the short side direction, when the direction of rotation of the stirring member is defined as the short side direction, and hence the irregularity occurs at the end of the front layer. Configurations other than the state of the end in the short side direction and the positional relationship in the longitudinal direction are the same in Example 3-2 and Example 2, and are the same in Comparative Example 3-2 and Comparative Example 2.

Comparison between Example 3-2 and Comparative Example 3-2 by Breakdown Test

With the configurations of Example 3-1 and Comparative Example 3-1, a breakdown test was actually conducted for 15000 pieces of the printing sheets until being outlined due to the toner shortage. Comparison of the remaining-amount-of-toner detection accuracy was conducted while confirming the state of separation of the surface layer of the conductive resin sheet as the antenna member 14 in this breakdown test.

First of all, the state of separation of the surface layer of the antenna member 14 is shown in Table 4.

TABLE 4

STATE OF SEPARATION OF SURFACE LAYER OF ANTENNA MEMBER BETWEEN EXAMPLE 3-2 AND COMPARATIVE EXAMPLE 3-2

| | 0 | 5000 pieces | 10000 pieces | 15000 pieces |
|---|---|---|---|---|
| Example 3-2 | no separation | no separation | no separation | no separation |
| Comparative Example 3-2 | no separation | no separation | slight separation | separation of 10% or more in surface area |

As shown in Table 4, in the configuration of Example 3-2 had no problem, separation of the surface layer of the antenna member 14 occurred when the number of pieces of the printing sheets is increased to 10000 pieces or more in the configuration of Comparative Example 3-2. The term "separation of the surface layer" means the state in which part of the surface layer is completely separated, and the conductive layer of the corresponding part is missing.

It seems that the reason why there was no separation in the configuration of Example 3-1 was that the stirring sheet did not come into contact with the end of the conductive resin sheet in the short side direction. In Comparative Example 3-2, the stirring sheet came into contact with the minute irregularity at the end of the surface layer in the short side direction repeatedly, and hence was susceptible to separation.

Transition of the output of the remaining amount of toner at the time of the breakdown test was equivalent to that shown in FIG. 7. In the case of Example 3-2, a remaining amount of toner of 0% could be detected immediately before being outlined due to the toner shortage, and the detection of the remaining amount of toner could be performed normally. However, in the configuration of Comparative Example 3-2, a remaining amount of toner of 0% was detected significantly before being outlined due to the toner shortage. The reason is the same as that described in Example 3-1 and Comparative Example 3-1, and hence description is omitted.

In the case of the design as in Comparative Example 3-1, it is necessary to design the developer container which requires the replacement when the number of printing sheets reached approximately 5000 pieces as is understood from Comparative Example 3-1. Accordingly, separation caused by the repeated contact of the stirring sheet is avoided, so that the detection accuracy of the remaining amount of toner becomes equivalent to that in Example 3-1.

As has been described thus far, even though minute irregularity was generated on either one of the ends of the surface layer of the conductive resin sheet having the two-layer structure in the longitudinal direction and the short side direction, separation or breakage of the antenna member 14 may be reduced with the configuration of Example 3. Therefore, deterioration in remaining-amount-of-toner detection accuracy due to the separation of the surface layer of the antenna member 14 may be reduced.

Although the case of the two-layer structure has been described in Example 3, the same advantageous effects are achieved even with three or more layers.

Although the conductive resin sheet having a plurality of number of layers with irregular surface at the end of the surface layer has been employed in Example 3, the layer structure having a plurality of layers such as the two-layer structure and the three-layer structure may be employed even with the conductive resin sheet having no irregularity.

Even though there is one layer of the conductive resin sheet, Example 3 may be applied in the case where there is directionality such as vertical or lateral as the resin structure. In other words, minute irregularity may occur when the sheet is cut off on end surfaces of either in the longitudinal direction or in the short side direction of the conductive resin sheet in accordance with the directionality of the resin structure. With this irregularity, the conductive resin sheet is in the state of generating the separation or the breakage easily. In the case of employing the antenna member as described above, the same advantageous effects may be obtained by employing the positional relationship with respect to the stirring sheet described in Examples 1 and 2.

Other Configurations

Figure 9:
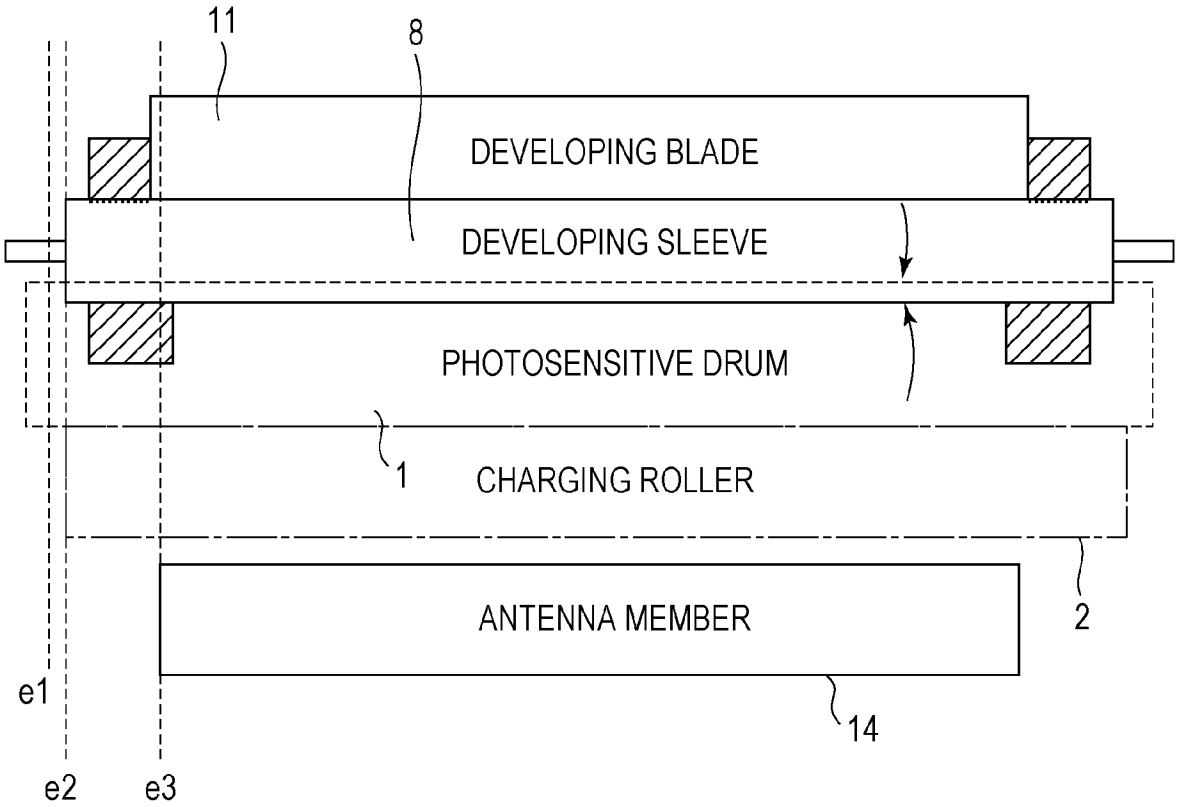
FIG. 9 is a drawing illustrating a positional relationship among end of the antenna member and components.

In Examples 1 and 2, the relationship between the longitudinal end of the conductive resin sheet and the stirring sheet has been described. However, the positions of the end of the developing sleeve as the developer bearing member in the longitudinal direction is important depending on machine types. Description will be given with reference to FIG. 9. For example, there is a case where it is preferable that an end (e2) of the developing sleeve in the longitudinal direction is located outside an end (e3) of the conductive resin sheet in the longitudinal direction. The reason is that the longer the end of the developing sleeve extends in the longitudinal direction, the larger the area that contributes to detect the amount of toner correspondingly, and hence the higher accuracy is achieved in detection of the remaining amount of toner. In the case where the positional relationship among the ends as described above is employed, the length of the developing sleeve in the longitudinal direction is larger than that of the conductive resin sheet in many cases.

The relationship between the charging roller as the charging member and the end of the conductive resin sheet is preferable such that an end (e1) of the charging roller in the longitudinal direction is located outside the end (e3) of the conductive resin sheet in the longitudinal direction. The reason is that discharge occurs also from an end surface of the charging roller in addition to discharge in the vicinity of the nip with respect to the drum, discharge concentrates at the end of the charging roller. Therefore, the amount of the drum abrasion corresponding to the end of the charging roller is larger than the amount of drum abrasion at other portions, and hence the film thickness of the OPC photosensitive layer is reduced. In such a case, at the end of the charging roller, the surface of the drum cannot have a normal surface potential, so that fog of toner tends to occur. In such a case, the toner is partly consumed at the end of the charging roller, and the amount of toner between the conductive resin sheet and the developing sleeve tends to vary. In order to minimize the influence of this phenomenon, the end of the charging roller in the longitudinal direction is located outside as much as possible to stabilize the amount of toner between the conductive resin sheet and the developing sleeve as much as possible, whereby further accurate detection of the remaining amount of toner is enabled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-197218 filed Sep. 24, 2013 and No. 2014-152908 filed Jul. 28, 2014, which are hereby incorporated by reference herein in their entirety.

What is claimed is:

1. A developer container configured to accommodate developer comprising:

a stirring member having a sheet member for stirring the developer; and a conductive resin sheet arranged in the developer container so as to come into contact with the sheet member for detecting an amount of developer by using electrostatic capacitance, wherein the conductive resin sheet includes (i) an antenna member which is arranged on an inner surface of a frame of the developer container and which is formed of a conductive resin, and (ii) a route portion which is formed of a conductive resin, and wherein an end of the antenna member in a longitudinal direction of the antenna member is provided outside an end of the sheet member in a longitudinal direction of the sheet member.

2. The developer container according to claim 1, wherein one end of the conductive resin sheet, one end of the sheet member, the other end of the sheet member, and the other end of the conductive resin sheet are located in this order in the longitudinal direction of the conductive resin sheet.

3. The developer container according to claim 1, wherein a distance between the end of the conductive resin sheet in the longitudinal direction and the end of the sheet member in the longitudinal direction is larger than 0 mm and not larger than 20 mm.

4. The developer container according to claim 1, wherein the end of the conductive resin sheet in the longitudinal direction includes an upstream end located on the upstream side of the stirring member in the direction of rotation thereof, and a downstream end located on the downstream side of the stirring member, and the end of the sheet member is located between the upstream end and the downstream end in the longitudinal direction of the conductive resin sheet.

5. The developer container according to claim 1, wherein the length of the conductive resin sheet in the longitudinal direction is longer than the length of the sheet member in the longitudinal direction.

6. The developer container according to claim 1, wherein the conductive resin sheet includes at least a first surface as a side surface located on the upstream side of the stirring member in the direction of rotation thereof, and a second surface configured to be capable of coming into contact with the developer.

7. The developer container according to claim 6, wherein a first shortest distance from an axis of rotation of the stirring member to the first surface is longer than a second shortest distance from the axis of rotation of the stirring member to the second surface.

8. The developer container according to claim 6, wherein a stirring distance from the axis of rotation to an end of the sheet member on the side coming into contact with the second surface has the following relationship:

second shortest distance < stirring distance < first shortest distance.

9. The developer container according to claim 1, further comprising an electrode at a position opposing the conductive resin sheet for detecting an amount of developer by using electrostatic capacitance.

10. A developing apparatus comprising:

the developer container according to claim 1, and a developer bearing member configured to bear developer.

11. The developing apparatus according to claim 10, wherein an end of the developer bearing member in a longitudinal direction is provided outside the end of the conductive resin sheet in the longitudinal direction.

12. A process cartridge comprising:

the developer container according to claim 1, and a developer bearing member configured to bear developer.

13. An image forming apparatus comprising:

the developer container according to claim 1, and a transfer device configured to transfer a developer image onto a transfer material.

14. A developer container configured to accommodate developer comprising:

a stirring member having a sheet member for stirring the developer; and a conductive resin sheet arranged so as to come into contact with the sheet member when the stirring member rotates and so as to detect an amount of developer by using electrostatic capacitance, and wherein the conductive resin sheet includes at least a first surface as a side surface thereof located on the upstream side of the stirring member in a direction of rotation thereof, and a second surface located on the downstream side of the first surface in the direction of rotation, and wherein at the time of rotating and coming into contact with the conductive resin sheet, one end of the sheet member is configured to start contact with the conductive resin sheet from the second surface without contacting the first surface.

* * * * *